US010639532B2

(12) United States Patent
Jackson

(10) Patent No.: US 10,639,532 B2
(45) Date of Patent: May 5, 2020

(54) PRECISION BASKETBALL-HANDLING TRAINING TOOL

(71) Applicant: Freddie Joemaine Jackson, Vancouver, WA (US)

(72) Inventor: Freddie Joemaine Jackson, Vancouver, WA (US)

( * ) Notice: Subject to any disclaimer, the term of this patent is extended or adjusted under 35 U.S.C. 154(b) by 0 days.

(21) Appl. No.: 16/229,515

(22) Filed: Dec. 21, 2018

(65) Prior Publication Data

US 2020/0030678 A1 Jan. 30, 2020

Related U.S. Application Data

(60) Provisional application No. 62/703,287, filed on Jul. 25, 2018.

(51) Int. Cl.
*A63B 69/00* (2006.01)
*A63B 63/08* (2006.01)

(52) U.S. Cl.
CPC ..... *A63B 69/0071* (2013.01); *A63B 63/083* (2013.01); *A63B 2220/10* (2013.01); *A63B 2220/80* (2013.01); *A63B 2243/0037* (2013.01)

(58) Field of Classification Search
CPC . A63B 69/071; A63B 63/083; A63B 2220/10; A63B 2220/80; A63B 2243/0037
USPC ..... 473/422, 433–435, 447, 448, 479–489
See application file for complete search history.

(56) References Cited

U.S. PATENT DOCUMENTS 989,944 A * 4/1911 Bramson ..... A63B 19/02 362/184
2,928,206 A * 3/1960 Kuhn ..... A63H 33/02 446/247
3,509,660 A * 5/1970 Seymour ..... A63B 21/0608 446/38
3,911,264 A * 10/1975 Chao ..... A63B 19/00 446/439
4,006,556 A * 2/1977 Williams ..... A63B 19/00 446/242
4,480,831 A * 11/1984 Muller-Deinhardt ..... A63B 21/0608 446/236
4,915,666 A * 4/1990 Maleyko ..... A63B 19/00 446/242
4,984,787 A * 1/1991 Nesbit ..... A63B 63/083 473/481

(Continued)

*Primary Examiner* — Mitra Aryanpour
(74) *Attorney, Agent, or Firm* — Stoel Rives LLP

(57) ABSTRACT

A precision ball-handling training tool develops accuracy and proficiency in basketball control of an athlete performing no-look dribbling of a basketball. A non-opaque tubular member terminating in a body member forms a ring having a perimeter that defines an open space inside the perimeter. A light source is positioned within the tubular member to emit light from and along its length. The emitted light is sufficiently intense to be perceived by the athlete performing no-look dribbling of the basketball within the open space. Opposed light beam switch components positioned at the perimeter of the ring define a line-of-sight across the open space. Power supply and processor circuitry contained in the body member responds to instances of a basketball obstructing the line-of-sight during a basketball dribbling exercise by causing momentary light emissions from the light source to indicate whenever the athlete dribbles the basketball within the open space of the ring.

20 Claims, 3 Drawing Sheets

(56) References Cited

U.S. PATENT DOCUMENTS

| | | | | | |
|---|---|---|---|---|---|
| 4,991,837 | A * | 2/1991 | Deal | A63B 63/083 | 473/485 |
| 5,083,964 | A * | 1/1992 | Arad | A63B 19/00 | 446/236 |
| 5,108,340 | A * | 4/1992 | Farrow | A63B 19/00 | 446/219 |
| 5,192,080 | A * | 3/1993 | Duncan | A63B 63/083 | 473/479 |
| 5,305,998 | A * | 4/1994 | Nesbit | A63B 63/083 | 473/481 |
| 5,403,000 | A * | 4/1995 | Woosley | A63B 43/06 | 473/447 |
| 5,711,727 | A * | 1/1998 | Edge | A63B 43/06 | 473/479 |
| 5,833,558 | A * | 11/1998 | Pettle | A63B 63/083 | 473/479 |
| 5,916,048 | A * | 6/1999 | Hurell | A63B 43/06 | 473/479 |
| 6,036,573 | A * | 3/2000 | Huang | A63B 19/00 | 446/242 |
| 6,607,456 | B2 * | 8/2003 | Yu | A63B 63/083 | 473/485 |

* cited by examiner

PRECISION BASKETBALL-HANDLING TRAINING TOOL

RELATED APPLICATION

This application claims benefit of U.S. Patent Application No. 62/703,287, filed Jul. 25, 2018.

TECHNICAL FIELD

This disclosure relates generally to athletic skills training equipment and, in particular, to a precision basketball dribbling training tool that enhances a basketball player's no-look ball control skill development.

BACKGROUND INFORMATION

While dribbling a basketball, a basketball player exhibiting ball-handling proficiency does not look down at the court floor to watch the basketball. A player skilled in no-look basketball control while dribbling can become more adept in maneuvering around closely guarding defenders and take advantage of enhanced court vision to find open teammates on offense and distribute the ball to one of them.

A basketball player participating in a basketball training drill typically stands stationary in a triple threat position (i.e., knees slightly bent, feet spread shoulder width apart) and dribbles the basketball at a high rate of speed. The basketball player attempts to bounce the basketball consistently to the same court floor location while refraining from looking down at the court floor and to count the number of bounces of the basketball during the training drill. Looking away from the basketball and concurrently counting the number of bounces of the basketball make it difficult for the basketball player to perceive the extent to which the basketball bounces consistently to the same court floor location. An inability to no-look dribble the basketball repeatedly from the same court floor location impedes ball-handling control skill development. A basketball player having mastered no-look control of the basketball while dribbling can develop court vision that facilitates maneuverability across the court floor while scanning for an unguarded teammate to whom to pass the basketball.

What is needed is a precision ball-handling tool for use in basketball dribbling training drills that enhance a player's accuracy and proficiency in no-look basketball control.

SUMMARY OF THE DISCLOSURE

A precision ball-handling tool is configured for use by an athlete in performing basketball dribbling training drills to develop accuracy and proficiency in no-look basketball control and thereby enhance the athlete's basketball court vision. In preferred embodiments, a non-opaque tubular member has a length and first and second ends that terminate in a body member having an inner exterior surface. The tubular member and the inner exterior surface of the body member are shaped to form a ring having a perimeter that defines an open space inside the perimeter.

A light source positioned within the tubular member is configured to emit light from and along the length of the tubular member. The light, when emitted, is of sufficient intensity to be perceived by the athlete while not looking directly at the ring and dribbling a basketball within the open space. First and second light beam switch components positioned in opposition to each other at the perimeter of the ring define between them a line-of-sight across the open space of the ring.

Power supply and processor circuitry contained in the body member is operatively connected to the light source and the first and second light beam switch components. The power supply and processor circuitry, in response to instances of a basketball obstructing the line-of-sight during the basketball dribbling exercise, causes momentary light emissions from the light source to indicate whenever the athlete dribbles the basketball within the open space of the ring.

Additional aspects and advantages will be apparent from the following detailed description of preferred embodiments, which proceeds with reference to the accompanying drawings.

DETAILED DESCRIPTION OF PREFERRED EMBODIMENTS

Figure 1:
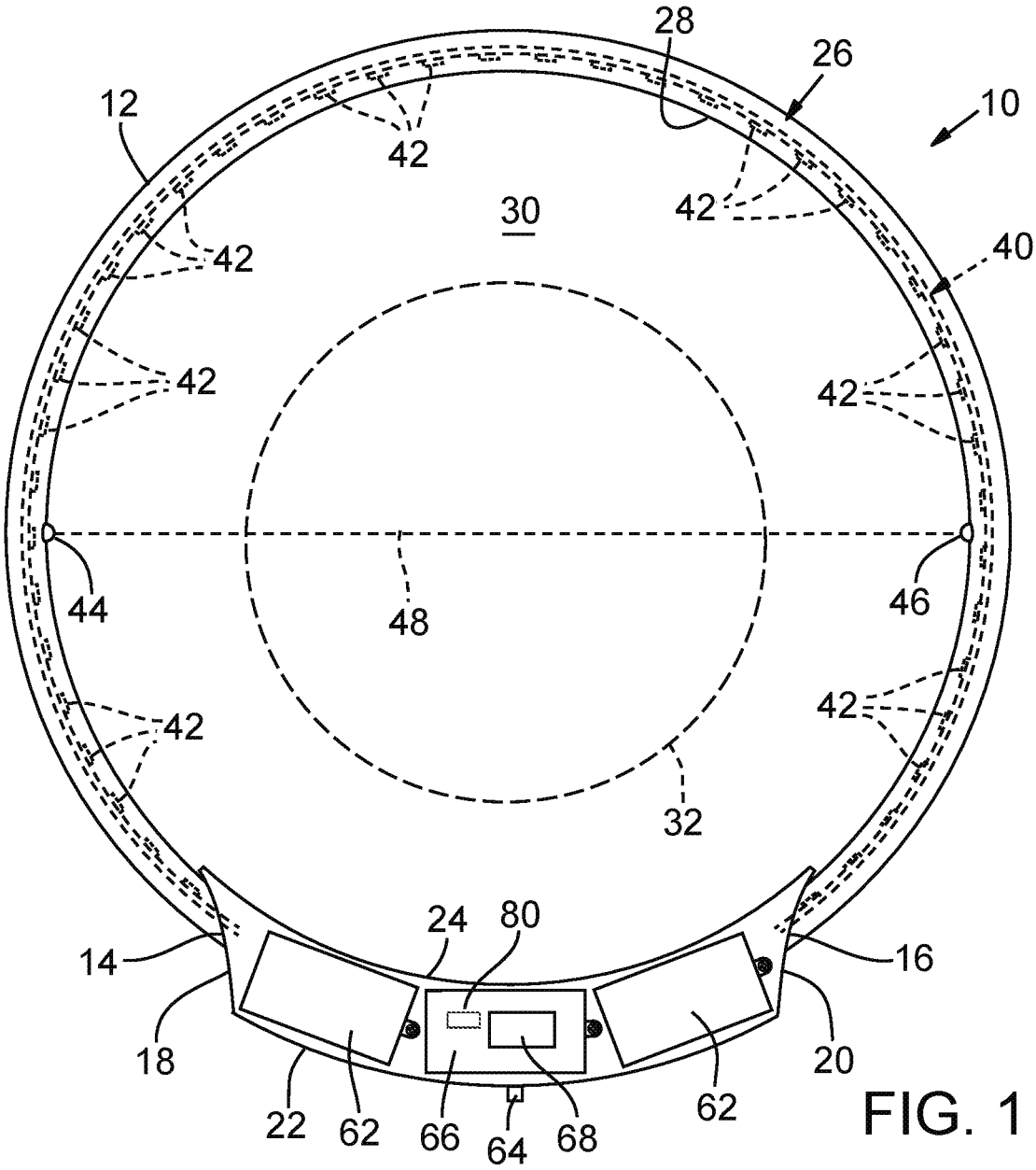
FIG. 1 is a top plan view of a precision basketball-handling tool configured in accordance with the present disclosure.
Figure 2:
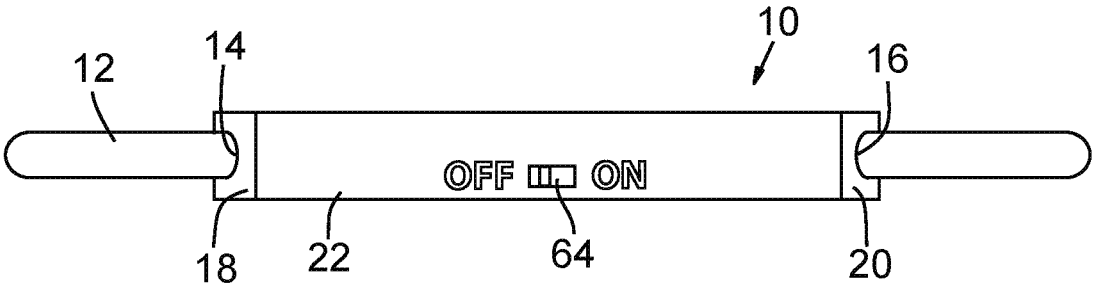
FIGS. 2 and 3 are, respectively, front side elevation and exploded views of the precision basketball-handling tool of FIG. 1.
Figure 3:
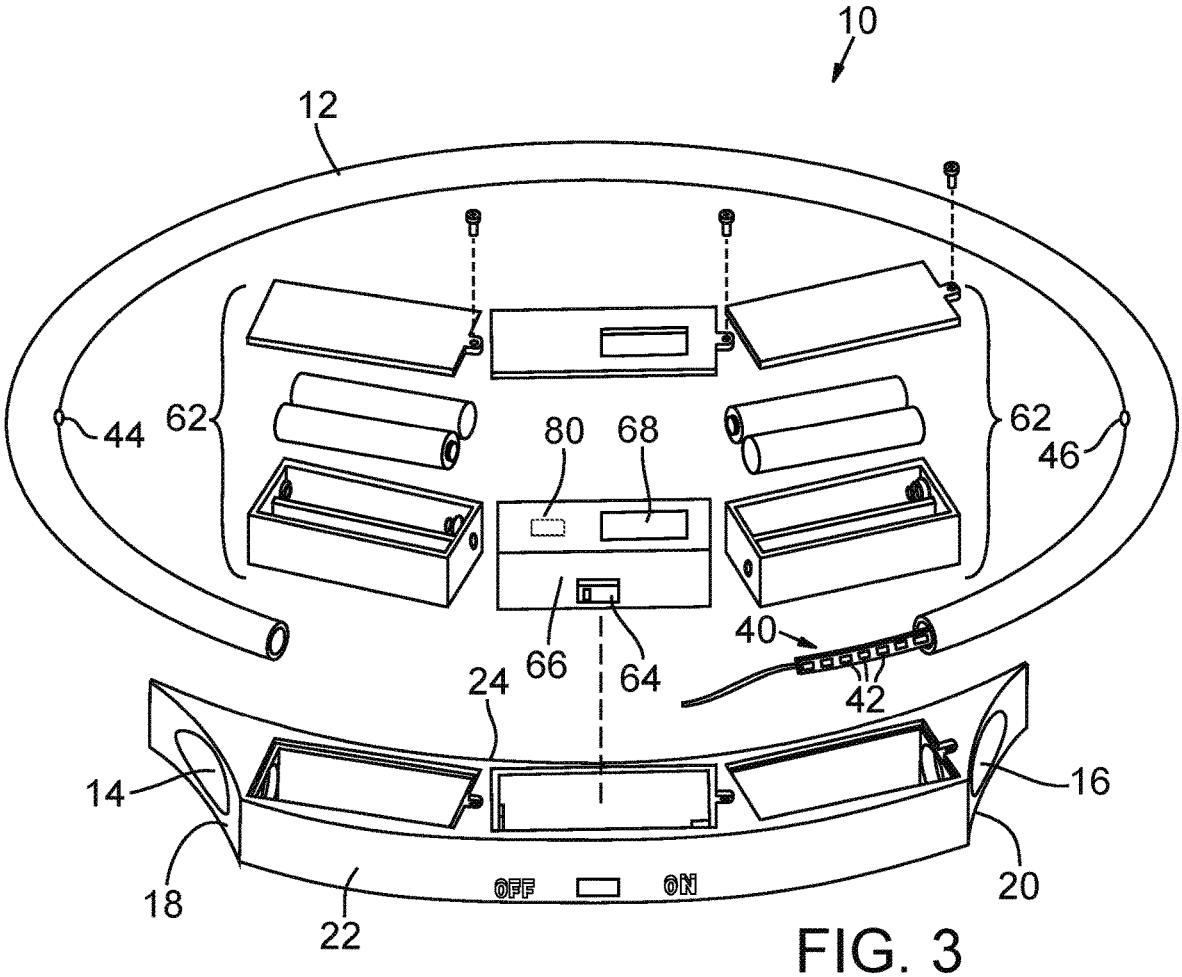

FIGS. 1, 2, and 3 show a precision ball-handling tool 10 for use by a basketball player while practicing basketball dribbling training drills that enhance no-look basketball control skill development. Precision ball-handling tool 10 includes a non-opaque (i.e., optically transparent or translucent) tubular member 12 having a first end 14 and a second end 16 that terminate in, respectively, a first opposite side 18 and a second opposite side 20 of a body member 22. Body member 22 has an arcuate inner exterior surface 24, which in combination with tubular member 12, forms a ring 26 having a perimeter 28. Perimeter 28 defines an open space 30 inside of ring 26. A basketball 32 depicted in phantom lines is shown positioned at the center of open space 30.

A light source 40 is set within and extends along the length between first end 14 and second end 16 of tubular member 12. Light source 40 is configured to emit light of sufficient intensity that can be perceived in the peripheral vision of the basketball player while practicing no-look dribbling a basketball 32 within open space 30. Light source 40 preferably includes a string of spaced-apart light-emitting devices 42, such as light-emitting diodes (LEDs). An example of a suitable tubular member 12 is commercially available 0.5 in. (12.7 mm) inner diameter, 0.625 in. (15.9 mm) outer diameter translucent polyethylene tubing. An example of a suitable light source 40 that fits within tubular member 12 is a commercially available 5 volt, 5 mm width white LED strip light that is cuttable at each LED 42.

A first light beam switch component 44 and a second light beam switch component 46 are positioned in opposition to each other at perimeter 28 of ring 26 to define a line-of-sight 48 across open space 30. Ring 26 is preferably of generally circular shape, and light beam switch components 44 and 46 are positioned at perimeter 28 such that line-of-sight 48 defines a diameter of ring 26. Ring 26 has a diameter of between about 15 in. (38.1 cm) and about 16 in. (40.64 cm) for the reasons given below. Light beam switch components 44 and 46 preferably form an electrically powered photoelectric switch in which first switch component 44 is a light emitter and second switch component 46 is a light detector. An example of a suitable photoelectric switch is an Adafruit ADA2168 IR Break Beam Sensor photoelectric switch with 5 mm LEDs. Line-of-sight 48 in the form of an optical beam path between light emitter 44 and light detector 46 traverses open space 30 of ring 26. Each bounce of basketball 32 within open space 30 of ring 26 causes an obstruction in the form of a beam break in optical beam path 48 between light emitter 44 and light detector 46.

Figure 4:
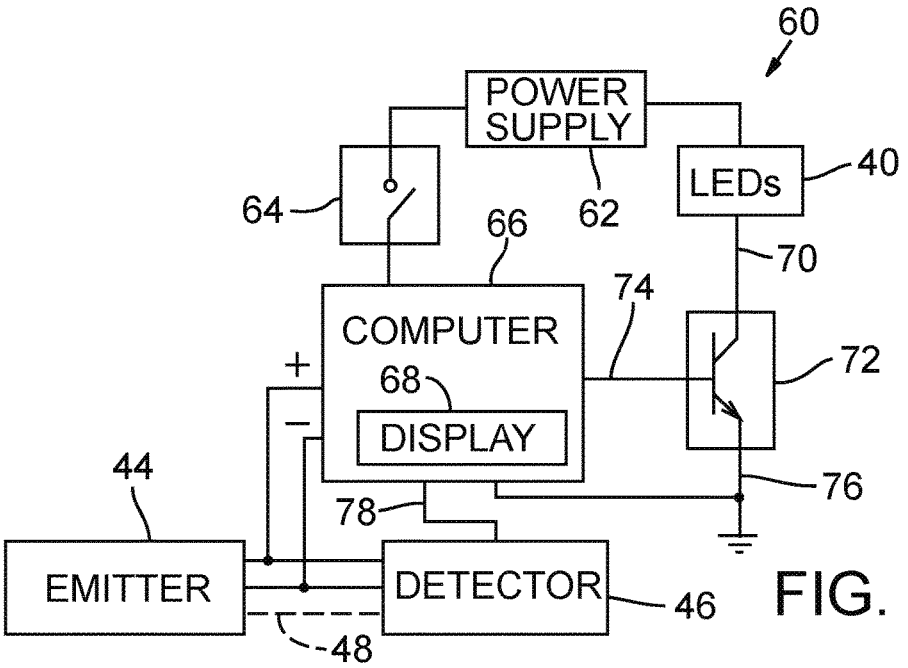
FIG. 4 is a block diagram of power supply and processor circuitry housed in a body member of the precision basketball-handling tool of FIG. 1.

FIG. 4 is a block diagram showing power supply and processor circuitry 60 housed in body member 22. Circuitry 60 includes a power supply 62, i.e., a battery, which provides +5 volts to the positive side of LEDs 42 of light source 40 and to a terminal of a main ON/OFF switch 64. When actuated to the ON state, ON/OFF switch 64 provides electric power to a computer 66, which has a display 68. A preferred computer 66 is an ESP 32 Development Board with 0.96 inch OLED Display WiFi Kit, which supports Arduinu IDE functionality and is available online from MakerFocus. Light emitter 44 and light detector 46 receive electric power from computer 66 to generate a light beam that propagates along optical beam path 48 between them. The negative side of LEDs 42 of light source 40 is connected to a collector terminal 70 of a transistor switch 72, which has a base terminal 74 and an emitter terminal 76. Base terminal 74 is connected to a control signal output of computer 66, and emitter terminal 76 is connected to ground potential. Light detector 46 develops on a sensor wire 78 connected to computer 66 a signal that indicates each instance of a beam break in optical path 48.

Whenever a bouncing basketball 32 breaks the beam in optical path 48, computer 66 responds to the signal developed on sensor wire 78 by applying to base terminal 74 of transistor 72 a voltage that causes current flow from collector terminal 70 to emitter terminal 76. Each of LEDs 42 is illuminated as a 30-millisecond light pulse during each beam break in optical beam path 48. Computer 66 is programmed to emit the momentary light pulse upon initiation of a beam break but not emit another momentary light pulse until after removal of the obstruction that caused the initial beam break. A single bounce of a properly inflated basketball 32 produces concurrent pulsed illumination of LEDs 42, and the frequency of light pulses emitted by LEDs 42 depends on the rate at which the basketball player is dribbling basketball 32 within open space 30. The pulse duration of LEDs 42 is shorter than the time between successive bounces of basketball 32 during a high-speed dribbling training drill.

Figure 5:
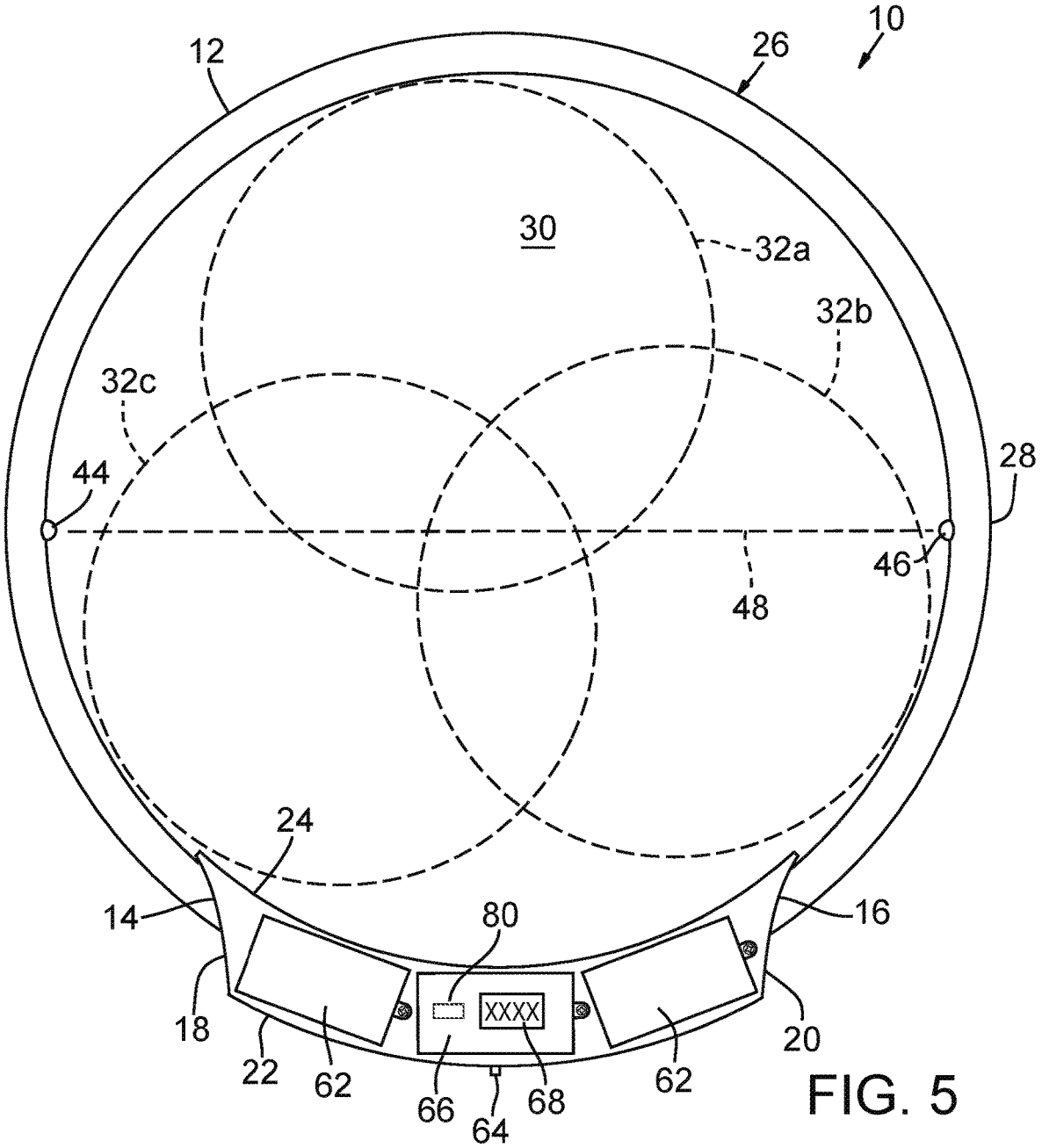
FIG. 5 is an enlarged top plan view showing three example locations where a basketball could be bounced in an open space of the precision basketball-handling tool of FIG. 1.

Computer 66 is programmed to check, at a 400 KHz rate, for a beam break and to record a single count in response to a beam break in optical beam path 48. Computer 66 counts each time when basketball 32 causes a beam break in optical beam path 48 and provides a cumulative count of beam breaks over a user-selected dribbling practice time interval. A manually operated reset button 80 (FIGS. 1, 3, and 5) allows a basketball player or trainer to clear display 68 of the cumulative count recorded by computer 66. FIG. 5 shows three example locations 32*a*, 32*b*, and 32*c* of basketball bounces in open space 30 that cause a beam break in optical beam path 48. Display 68 presents a real-time running count of beam breaks in optical beam path 48 during the user-selected time interval. Computer 66 processes beam break count-related information detailing performance of a basketball dribbling training drill.

To make advantageous use of precision ball-handling tool 10, a basketball player practicing no-look dribbling assumes a triple threat stance or position, positions basketball 32 over open space 30 of ring 26, looks away from basketball 32, and begins high-speed dribbling. Although not making direct eye contact with basketball 32 as it bounces, the basketball player sees in his peripheral vision light pulses emitted by LEDs 42. One count is recorded by computer 66 each time the basketball bounces in open space 30 of ring 26. If the basketball bounces outside of ring 26, LEDs 42 emit no light pulses. Display 68 shows in real time the cumulative count of basketball bounces in open space 30 for the duration of the training drill set by the basketball player or trainer monitoring the practice drill. A diameter of ring 26 of between about 15 in. (38.1 cm) and 16 in. (40.64 cm) is preferred because it sets within open space 30 a range of tolerance for consistent location of basketball placement that is indicative of good ball-handling control. This diameter range is appropriate for regulation basketballs of the NBA, NCAA, or WNBA, which specify basketball diameter ranges of 9.43 in. (23.95 cm)—9.51 in. (24.16 cm), 9.39 in. (23.85 cm)—9.55 in. (24.26 cm), and 9.07 in. (23.04 cm)—9.23 in. (23.44 cm), respectively.

It will be obvious to those having skill in the art that many changes may be made to the details of the above-described embodiments without departing from the underlying principles of the invention. The scope of the present invention should, therefore, be determined only by the following claims.

The invention claimed is:

1. A precision ball-handling tool for use by an athlete performing basketball dribbling training drills to develop proficiency in no-look basketball control and thereby to enhance the athlete's basketball court vision, comprising:

a non-opaque tubular member having a length and first and second ends terminating in a body member having an inner exterior surface, the tubular member and the inner exterior surface of the body member shaped to form a ring having a perimeter to define an open space inside the perimeter;

a light source positioned within and configured to emit light from, and along the length of, the tubular member, the light, when emitted, being of sufficient intensity to be perceived by the athlete while not looking directly at the ring and dribbling a basketball within the open space;

first and second light beam switch components positioned in opposition to each other at the perimeter of the ring, the first and second light beam switch components defining between them a line-of-sight across the open space of the ring; and power supply and processor circuitry contained in the body member and operatively connected to the light source and the first and second light beam switch components, the power supply and processor circuitry, in response to instances of a basketball obstructing the line-of-sight during the basketball dribbling exercise, causing momentary light emissions from the light source to indicate whenever the athlete dribbles the basketball within the open space of the ring.

2. The ball-handling tool of claim 1, in which the light source includes a string of spaced-apart light-emitting devices.

3. The ball-handling tool of claim 2, in which the light-emitting devices are light-emitting diodes (LEDs).

4. The ball-handling tool of claim 1, in which the tubular member is formed of optically translucent, flexible material.

5. The ball-handling tool of claim 4, in which the tubular member is made of polyethylene.

6. The ball-handling tool of claim 1, in which the first and second light beam switch components include, respectively, a light emitter and a light detector that produce between them an optical beam path as the line-of-sight across the open space of the ring, and in which the dribbling of a basketball within the open space of the ring causes beam breaks in the optical beam path.

7. The ball-handling tool of claim 6, in which the light emitter emits infrared light and the light detector detects infrared light.

8. The ball-handling tool of claim 1, in which the power supply and processing circuitry includes a counter that records a number of instances of the obstruction of the line-of-sight during a basketball dribbling exercise.

9. The ball-handling tool of claim 8, in which the body member houses a display screen on which appears a count corresponding to the number of instances of the obstruction of the line-of-sight.

10. The ball-handling tool of claim 1, in which the ring is of generally circular shape.

11. The ball-handling tool of claim 10, in which the ring has a diameter of between about 15 in. (38.1 cm) and about 16 in. (40.64 cm).

12. The ball-handling tool of claim 1, in which each of the momentary light emissions has a duration that is less than a duration between two successive instances of dribbling the basketball within the open space of the ring during the basketball dribbling exercise.

13. The ball-handling tool of claim 1, in which one of the instances of a basketball obstructing the line-of-sight causes a momentary light emission from the light source and no other momentary light emission can occur before cessation of the incidence of a basketball obstructing the line-of-sight.

14. A method of enhancing basketball player ball control skill development, comprising:

placing on a floor a ring having a perimeter that defines an open space inside the perimeter, the ring including first and second light beam switch components positioned in opposition to each other at the perimeter to define a line-of-sight between them and cooperating with a powered light source to produce emission of light from the perimeter of the ring in response to an obstruction of the line-of-sight;

providing a basketball to a basketball player who is to assume a player's stance and position the basketball above and over the open space inside the perimeter of the ring in preparation to dribble the basketball; and performing a basketball dribbling exercise by the basketball player attempting to dribble the basketball within the open space and thereby repetitively obstruct the line-of-sight across the open space, and, in response to each obstruction of the line-of-sight, produce a momentary emission of light from the perimeter of the ring to indicate an instance of dribbling the basketball within the open space.

15. The method of claim 14, in which the light source includes a string of spaced-apart light-emitting devices.

16. The method of claim 14, in which the first and second light beam switch components include, respectively, a light emitter and a light detector that produce between them an optical beam path as the line-of-sight across the open space of the ring, and in which the dribbling of a basketball within the open space of the ring causes beam breaks in the optical beam path.

17. The method of claim 14, in which the ring includes a non-opaque tubular member having first and second ends terminating in a body member, the body member including a counter that records a number of instances of the obstruction of the line-of-sight during the basketball dribbling exercise and a display screen on which appears a count corresponding to the number of instances of the obstruction of the line-of-sight.

18. The method of claim 14, in which the ring is of generally circular shape and has a diameter of between about 15 in. (38.1 cm) and about 16 in. (40.64 cm).

19. The method of claim 14, in which each of the momentary light emissions has a duration that is less than a duration between two successive instances of dribbling the basketball within the open space of the ring during the basketball dribbling exercise.

20. The method of claim 14, in which one of the instances of a basketball obstructing the line-of-sight causes a momentary light emission from the light source and no other momentary light emission can occur before cessation of the incidence of a basketball obstructing the line-of-sight.

* * * * *